US008137243B2

(12) United States Patent
Coote

(10) Patent No.: US 8,137,243 B2
(45) Date of Patent: Mar. 20, 2012

(54) DANCE EXERCISE POLE

(75) Inventor: Clive Maxwell Coote, Hertfordshire (GB)

(73) Assignee: Vertical Leisure Ltd., Potters Bar (GB)

( * ) Notice: Subject to any disclaimer, the term of this patent is extended or adjusted under 35 U.S.C. 154(b) by 238 days.

(21) Appl. No.: 12/365,835

(22) Filed: Feb. 4, 2009

(65) Prior Publication Data

US 2010/0197464 A1 Aug. 5, 2010

(51) Int. Cl.
*A63B 22/00* (2006.01)

(52) U.S. Cl. ..... 482/51; 482/33; 248/354.1

(58) Field of Classification Search ..... 482/16, 482/17, 33, 36, 38, 39, 51, 148, 93, 106, 482/107, 108, 110, 131; 119/786; 248/351, 248/354.1, 354.3, 354.4, 354.5, 354.6; 463/47.7; 135/98

See application file for complete search history.

(56) References Cited

U.S. PATENT DOCUMENTS

| | | | | | |
|---|---|---|---|---|---|
| 2,625,356 | A | * | 1/1953 | Kennedy et al. | 248/121 |
| 2,697,603 | A | * | 12/1954 | Haines | 473/430 |
| 4,498,204 | A | * | 2/1985 | Warner | 4/559 |
| 5,056,753 | A | * | 10/1991 | Lunau et al. | 248/542 |
| 5,149,092 | A | * | 9/1992 | Parsons | 463/47.7 |
| 5,470,294 | A | * | 11/1995 | Ingram | 482/66 |
| 5,625,988 | A | * | 5/1997 | Killick | 52/298 |
| 5,826,847 | A | * | 10/1998 | Warner et al. | 248/354.1 |
| 5,971,891 | A | * | 10/1999 | Humphrey | 482/51 |
| 6,554,235 | B1 | * | 4/2003 | Fortier | 248/122.1 |
| 6,745,785 | B2 | * | 6/2004 | Kotovsky | 135/65 |
| D561,274 | S | * | 2/2008 | Turner et al. | D21/679 |
| 7,338,411 | B2 | * | 3/2008 | Blacker | 482/33 |
| 2008/0146423 | A1 | * | 6/2008 | Ammon et al. | 482/131 |
| 2008/0271353 | A1 | * | 11/2008 | Montell | 40/606.03 |

FOREIGN PATENT DOCUMENTS

| | | | |
|---|---|---|---|
| WO | 2005049967 | A1 | 6/2005 |
| WO | WO 2005049967 | A1 * | 6/2005 |

* cited by examiner

*Primary Examiner* — Loan Thanh
*Assistant Examiner* — Tam Nguyen
(74) *Attorney, Agent, or Firm* — BainwoodHuang

(57) ABSTRACT

A dance exercise pole has a base, a lower cylindrical section journalled for rotation on the base about a substantially vertical axis, a connector extending upwardly from the upper end of the lower cylindrical section, and a lowermost pole section having an internally treaded portion at its lower end for connection to an externally treaded portion of the connector whereby the height of the pole section is vertically adjustable. A sleeve is mounted to slide over the outside of the lower cylindrical section and may be detachably connected to the lowermost pole section.

28 Claims, 5 Drawing Sheets

DANCE EXERCISE POLE

The invention relates to dance exercise poles, and in particular to portable poles which can be erected and dismantled at different sites.

Poles for use in dance exercise have become very popular in recent years. Such poles extend between floor and ceiling and generally have a ground engaging base and a ceiling assembly. The poles comprise one or more pole sections connected together in series according to the height required and an adjustable section must be provided so that the overall height of the pole enables it to fit closely against both floor and ceiling. It is also essential that the part of the pole which is used by the dancer is completely smooth. For this reason adjustment of the overall height is normally provided by a threaded adjustment between the uppermost pole section and the ceiling assembly. This is inconvenient since it is usually necessary to stand on a chair or ladder to make the adjustment.

It is also generally preferred for the pole sections to be able to rotate relative to the base if required. A dance pole having height adjustment at its lower end has been proposed but the arrangement has precluded rotation of the pole sections relative to the base.

The present invention sets out to provide a dance exercise pole which can be height adjusted and height locked by means located at its lower end, which can permit rotation of the pole sections relative to the base with the height locked, and which presents a substantially smooth outer surface for engagement by a user over substantially the whole of the height of the pole.

Accordingly, the present invention provides a dance exercise pole comprising: a base; a lower cylindrical section journalled for rotation on the base about a substantially vertical axis; a connector extending upwardly from the lower cylindrical section and having an externally threaded portion; a lowermost pole section having an internally threaded portion at its lower end for connection to the externally threaded portion of the connector, such that the position of the pole section is vertically adjustable by relative rotation of the pole section on the connector; means for selectively locking the pole section against relative rotation on the connector; and a sleeve depending from the lowermost pole section and mounted to slide over the outside of the lower cylindrical section.

An embodiment of the present invention is described below with reference to the accompanying drawings, in which.

Figure 1:
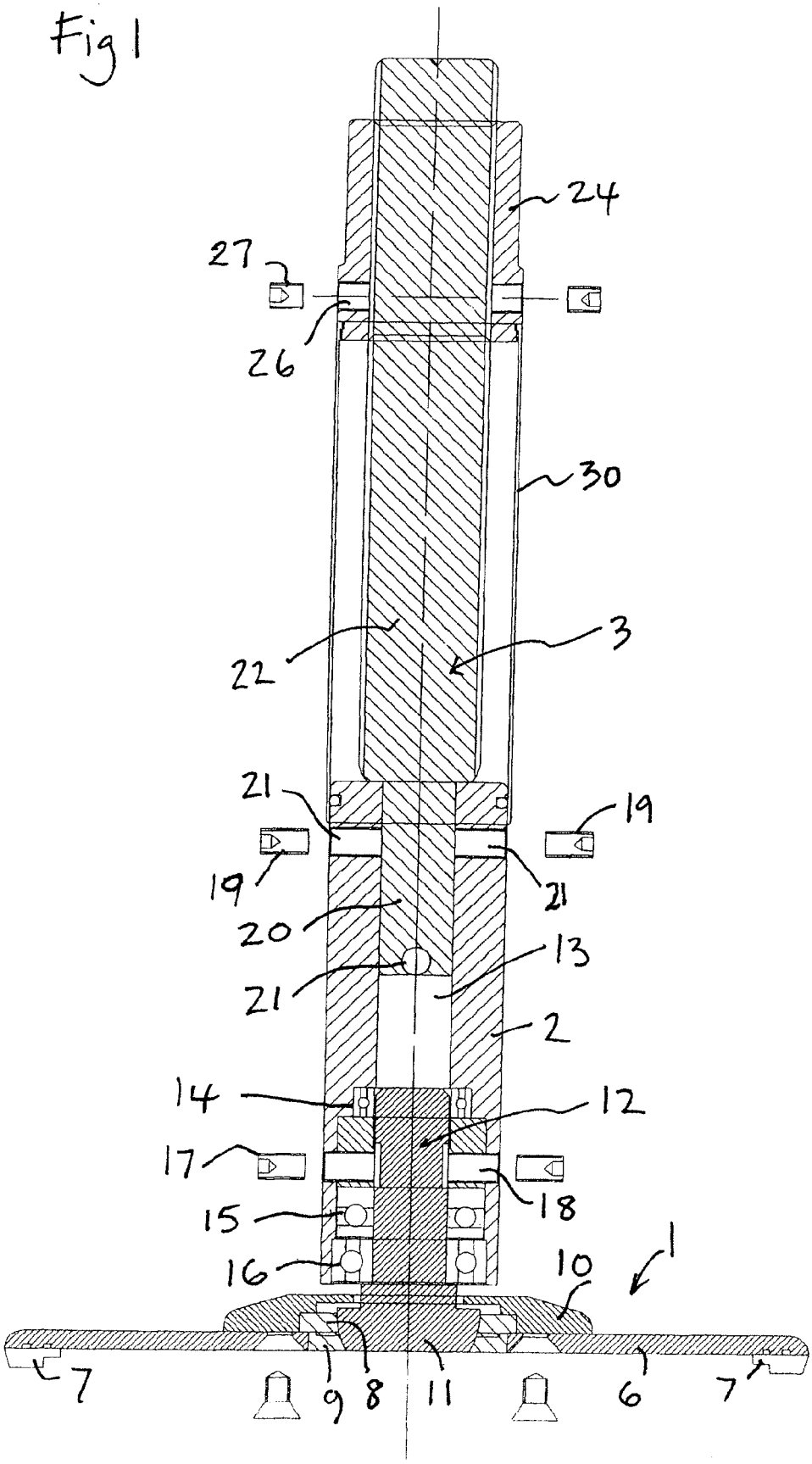
FIG. 1 is a vertical cross-section of the lower part of a pole in a first adjustment position.
Figure 2:
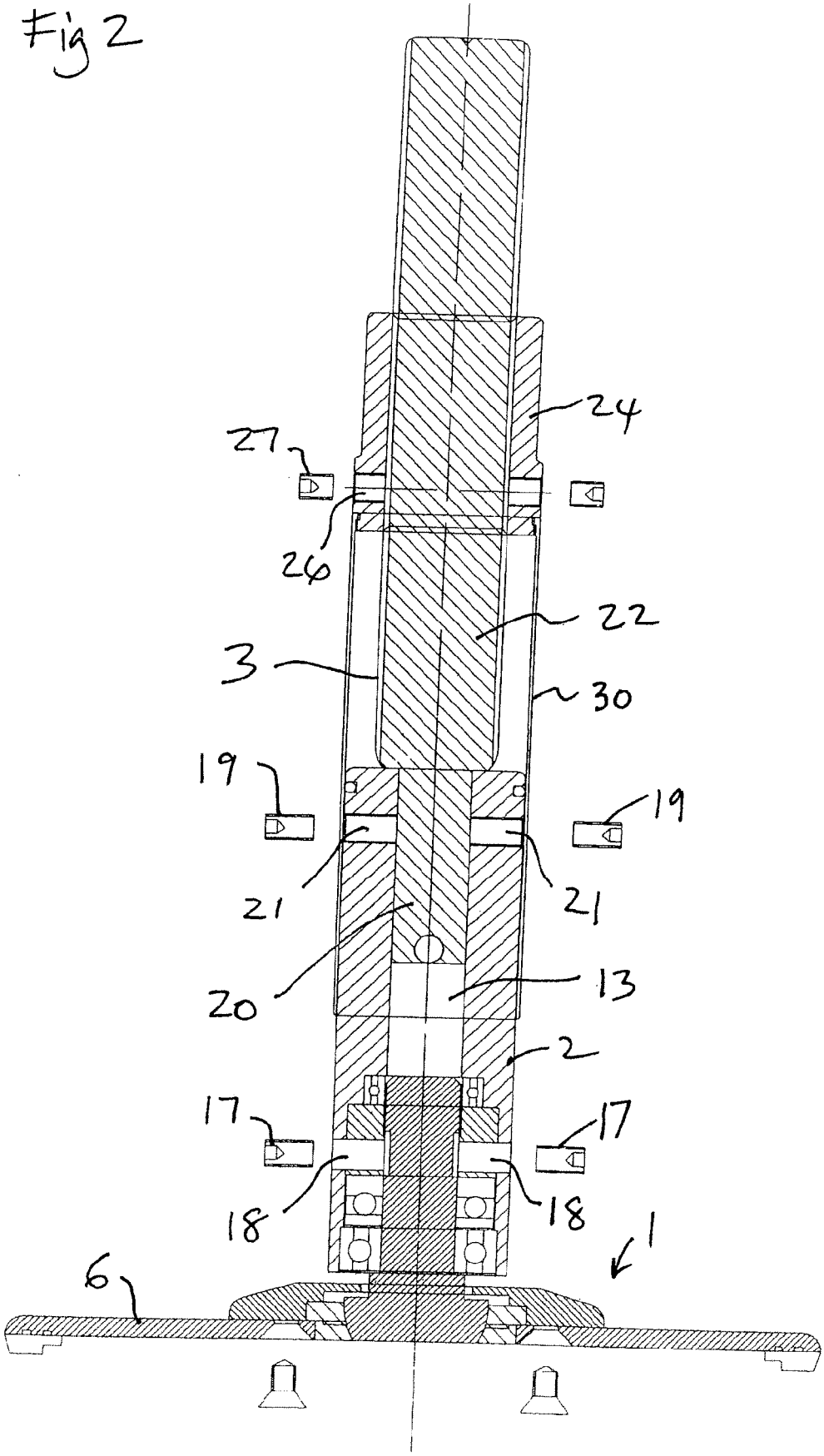
FIG. 2 is a view similar to FIG. 1 but with the pole in a second adjustment position.

A dance exercise pole shown in the drawings comprises a base 1, a lower cylindrical section 2, an adjustable connector 3, a plurality of pole sections 41 and 42 and a ceiling assembly 5. Referring firstly to FIGS. 1 and 2, the base 1, lower cylindrical section 2 and connector 3 are described in more detail below.

The base 1 comprises a floor engaging plate 6 having a plurality of feet 7. Bearing plates 8 and 9 are retained at the centre of the floor plate 6 by a locking ring 10 and provide a part spherical journal for a part-spherical enlargement 11 formed on the lower end of an upright pole axle 12. By virtue of the part-spherical journal thus provided, the axle 12 and the floor plate 6 can move slightly relative to one another so that the axle can remain upright on slightly sloping or irregular floors. Rotation of the axle 12 about its own axis is prevented, however.

The lower cylindrical section 2 of the exercise pole has a central bore 13 running through its length and is supported and journalled on the axle 12 by bearings 14, 15 and 16 surrounding the lower part of the bore 13.

Grub screws 17, threaded in radial bores 18, can engage flats formed on the axle to lock the lower cylindrical section 2 against rotation on the axle 12. A marking on the base indicates the position of the flats.

The connector 3 has a lower portion 20 which is a close sliding fit in the upper part of the bore 13. Grub screws 19 in bores 21 serve to prevent rotation of the connector 3 relative to cylindrical section 2. The lower portion 20 may be provided with flats for this purpose.

The upper portion 22 of the connector 3 is externally threaded along its length and extends upwardly from the lower cylindrical section to provide for both attachment of the lowermost pole section 41 and adjustment of the vertical position of the pole by relative rotation between the pole section and the connector. In practice this is achieved by relative rotation between the pole section 41 and the lower cylindrical section 2 to which the connector is firmly coupled.

As shown, the connector 3 is formed as a separate component from the lower cylindrical section 2. This is because it is preferred for them to be made from different metals. In use, however, the connector 3 need never be separated from the lower cylindrical section so they may be formed integrally or permanently fixed together.

Figure 3:
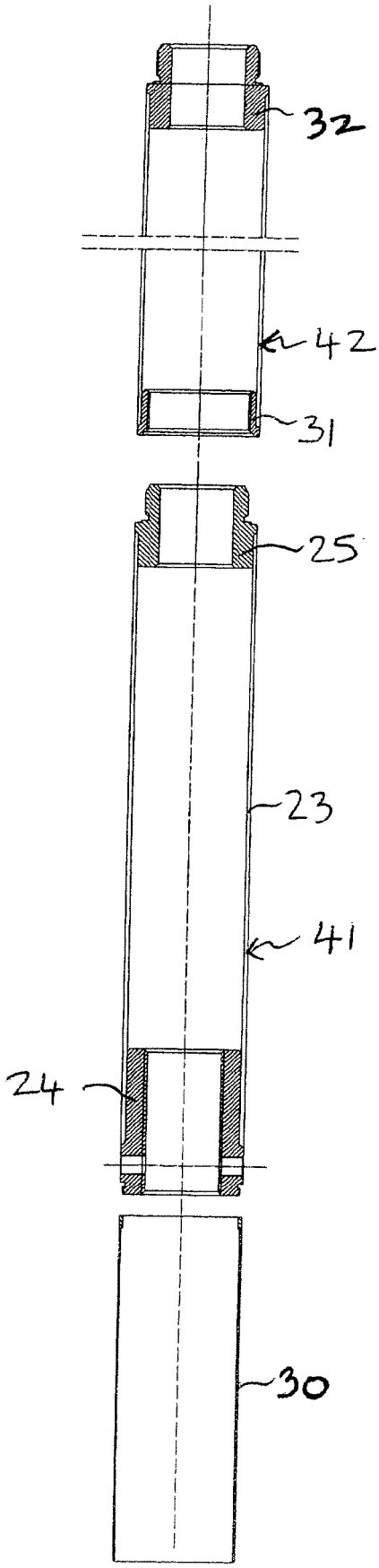
FIG. 3 is a vertical cross-section through two pole sections and a sleeve.

As shown in FIG. 3, for example, the lowermost pole section comprises a smooth cylindrical tube 23 having an internally threaded portion at its lower end, provided by a lower cylindrical insert 24, and an externally threaded portion at its upper end provided by an upper cylindrical insert 25. The pole section 41 can be adjusted up and down on the connector 3 by rotation and then locked in position by grub screws 27 located in radial bores 26 formed in the lower insert. The grub screws engage flats (not shown) formed on the upper portion 22 of the connector 3. The pole section 41 is thus locked against rotation relative to the connector 3 and the lower cylindrical section 2. In FIG. 1, the uppermost adjustment position of the pole section is indicated whereas in FIG. 2 a lower position is indicated.

In order to maintain a smooth outer surface of the pole, a covering sleeve 30 depends from the lowermost pole section 41 and is detachably connected thereto. The sleeve is a smooth cylindrical tube which has an internal thread at its upper end for engagement with an external thread formed at the lower end of the insert 24. The diameters of the various components are selected such that the external diameters of the pole sections 41 and 42 are the same as that of the sleeve 30. The internal diameter of the sleeve is just great enough for it to slide over the lower cylindrical section 2. As an alternative to the screw threaded connection described, the sleeve 30 may be detachably connected to the lowermost pole section 41 by a bayonet fitting or other suitable means. In another embodiment (not shown) the sleeve may be permanently fixed to the lowermost pole section.

Figure 4:
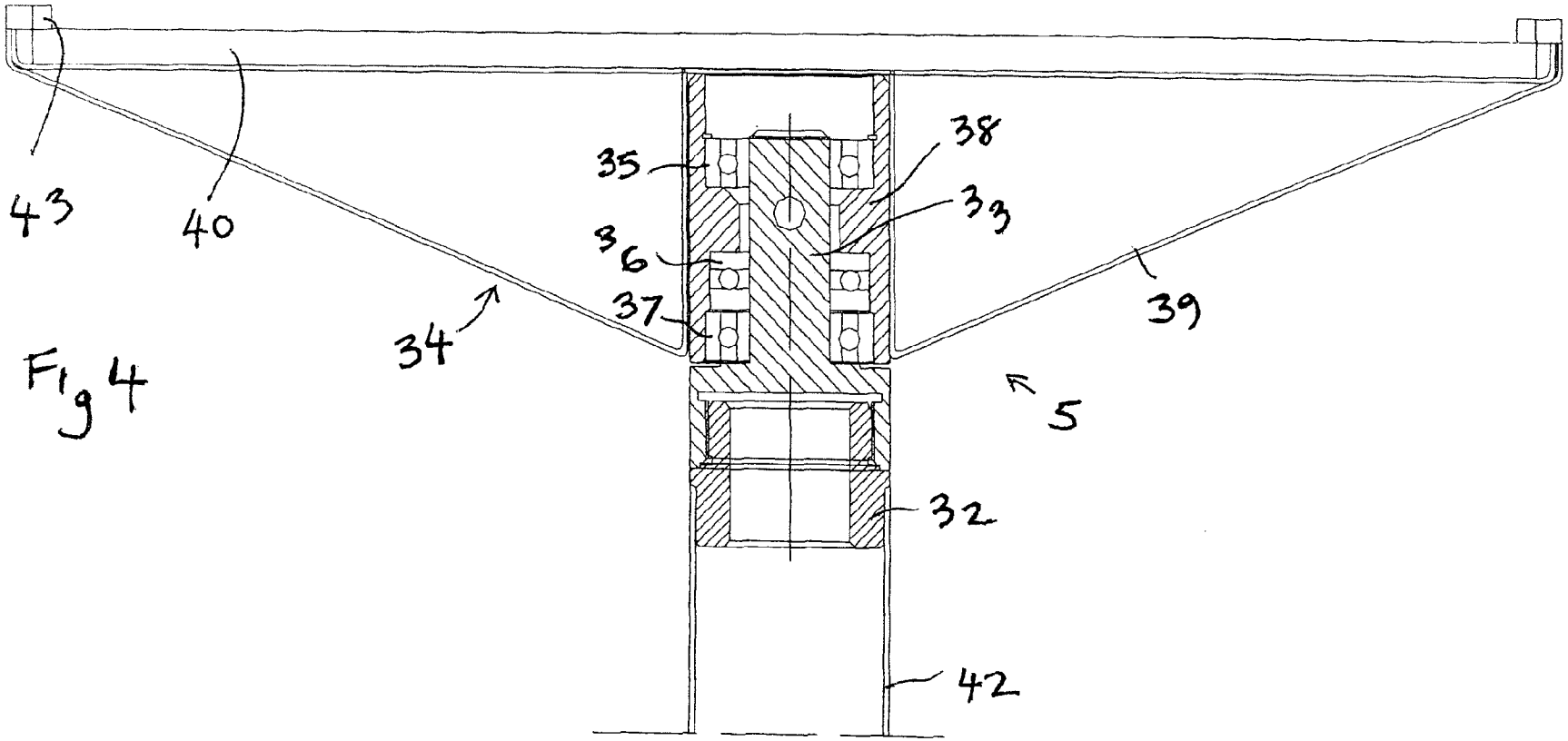
FIG. 4 is a detail of the uppermost pole section and a ceiling assembly.
Figure 5:
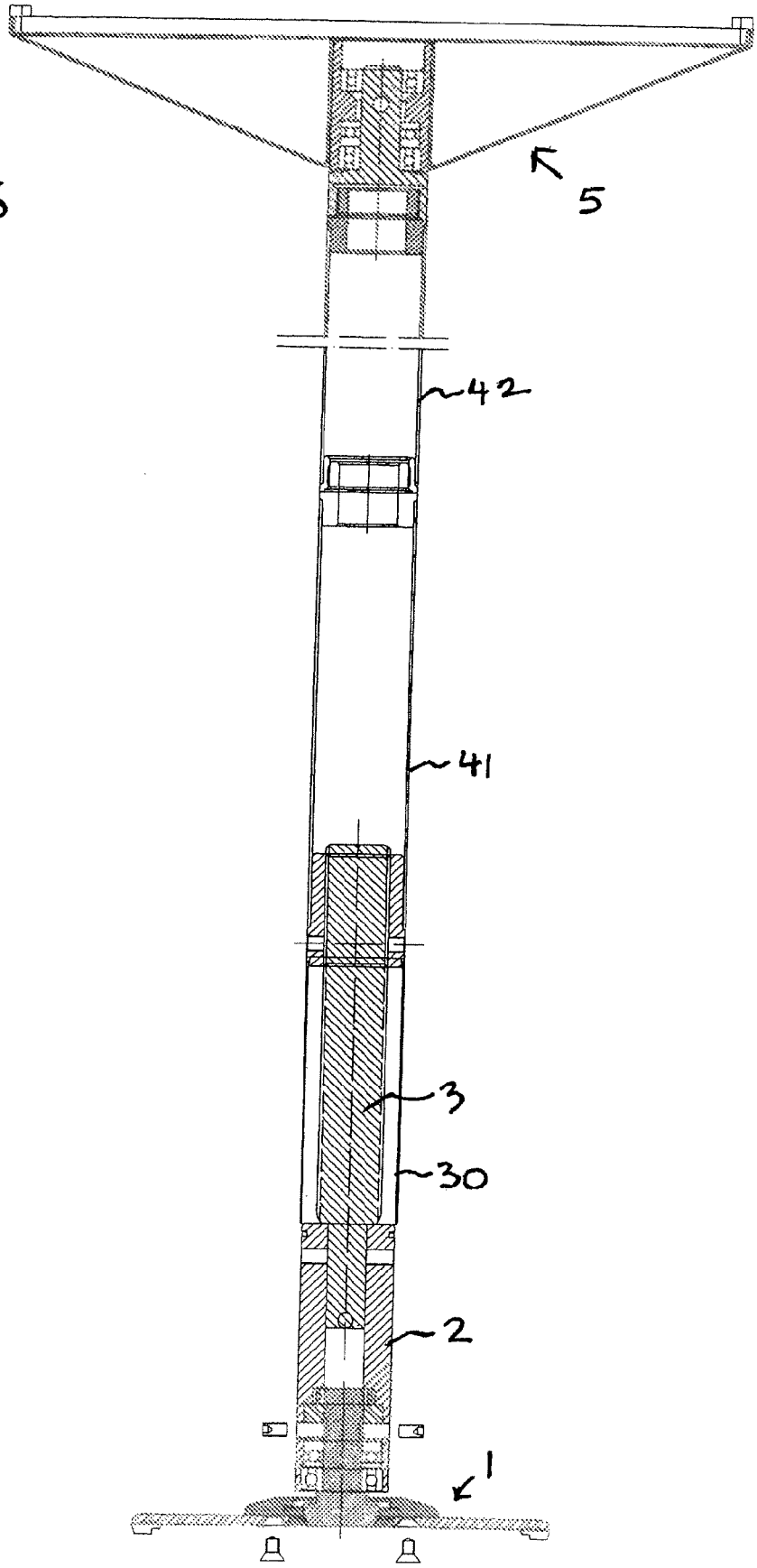
FIG. 5 is a vertical cross-section through a complete pole.

The uppermost pole section 42, seen in FIGS. 3-5, has a lower insert 31 for connection to the upper insert 25 of a lower pole section (as shown this is the lowermost pole section 41) and an upper insert 32 for connection to the ceiling assembly 5. Upper inserts 25 and 32 are identical. Ceiling assembly 5 comprises an upper axle 33 fitted onto the pole section 42 and a ceiling unit 34 which is journalled for rotation on the upper axle 33 by means of bearings 35, 36 and 37. The ceiling unit 34 comprises a central hub 38, frustoconical surround 39 and a circular disc 40 with feet 43 which bear against the ceiling. Alternatively, the ceiling unit 34 could comprise a simple flat plate or be formed as a ribbed or spoked surround.

Two pole sections 41 and 42 have been described but it should be understood that a string of any number of pole sections, consisting of a lowermost pole section 41 and one or more upper pole sections 42, connected in series may be provided. Also the pole sections may have different lengths so that a suitable overall length of the pole can be achieved.

To assemble a pole in a room, a suitable string of pole sections, including a lowermost pole section 41 with a lower cylindrical section 2 attached by a connector 3, is mounted on a base and a ceiling plate assembly is provided on the uppermost pole section. Initially, the lowermost pole section is screwed fairly well down on the connector such that the ceiling plate is spaced below the ceiling. The pole string is then rotated on the connector to extend the height of the pole and bring about suitable engagement between the ceiling plate and the ceiling. During this adjustment, the lower cylindrical section is locked against rotation by the screws 17 and the sleeve 30 is detached and lowered from the pole section 41 so that the flats formed on the upper portion 22 of the connector are visible. When a tight fit of the ceiling assembly against the ceiling has been achieved, the pole string is locked to the connector 3 and the lower cylindrical section 2 by means of the grub screws 27 in the bores 26. If it is wished for the pole string to be rotatable relative to the base about the lower axle 12 during use of the pole, the grub screws 17 are released.

The invention claimed is:

1. A dance exercise pole comprising:

a base;

a section journalled for rotation on the base;

a connector extending from the section journalled for rotation on the base; and a pole section having a threaded portion at a first end for connection to a threaded portion of the connector, such that the position of the pole section is adjustable by relative rotation of the pole section on the connector;

the dance exercise pole being configured for selectively locking the pole section against relative rotation on the connector.

2. A dance exercise pole as claimed in claim 1, wherein a sleeve is arranged to be detachably connected to the pole section.

3. A dance exercise pole as claimed in claim 1, wherein a sleeve is formed at an end with an internal thread for engagement with an external thread formed on the first end of the pole section.

4. A dance exercise pole as claimed in claim 1, arranged so the pole section may be selectively locked against rotation relative to the base.

5. A dance exercise pole as claimed in claim 1, wherein an axle is supported on the base and the section journalled for rotation on the base is journalled for rotation on the axle and wherein the dance exercise pole is configured for selectively locking the section journalled for rotation on the base against rotation on the axle.

6. A dance exercise pole as claimed in claim 1, wherein the connector comprises a first portion which is received in a bore formed in the section journalled for rotation on the base and a second portion which has external threading.

7. A dance exercise pole as claimed in claim 1, wherein the pole section comprises a smooth cylindrical tube.

8. A dance exercise pole as claimed in claim 1, wherein a plurality of pole sections including a further pole section are provided connected together in series and wherein the further pole section is connected to a ceiling assembly comprising an axle fitted onto the further pole section and a ceiling unit journalled for rotation on the axle of the ceiling assembly and arranged for bearing against a ceiling.

9. A dance exercise pole as claimed in claim 2, wherein the sleeve has an outer diameter that is the same as an outer diameter of the pole section(s) and wherein an internal diameter of the sleeve allows the sleeve to slide over the section journalled for rotation on the base.

10. A dance exercise pole as claimed in claim 1, comprising a sleeve mounted to slide over the outside of the section journalled for rotation on the base and arranged to depend from the pole section.

11. A dance exercise pole according to claim 1, wherein the threaded portion of the pole section is an internally threaded portion and the threaded portion of the connector for connection to the internally threaded portion is an externally threaded portion of the connector.

12. A dance exercise pole as claimed in claim 1, wherein the pole section comprises an insert at its first end and an internally threaded portion of the pole section is provided by the insert.

13. A dance exercise pole as claimed in claim 2, wherein the pole section comprises an insert at its first end and an internally threaded portion of the pole section is provided by the insert and wherein the insert is further provided with an external thread for engagement with an internal thread formed on an end of the sleeve.

14. A dance exercise pole as claimed in claim 1, wherein the section journalled for rotation on the base is a lower cylindrical section journalled for rotation about a substantially vertical axis; the pole section is a lowermost pole section; the first end of the pole section is a lower end of the pole section; and/or the position of the pole section is vertically adjustable by relative rotation of the pole section on the connector.

15. A part of a dance exercise pole, said part comprising:

a base;

a section journalled for rotation on the base; and a connector extending from the section journalled for rotation on the base, said connector having a threaded portion connecting to a threaded portion at a first end of a pole section of a dance exercise pole such that the position of the pole section is adjustable by relative rotation of the pole section on the connector;

the part being configured for selectively locking the pole section against relative rotation on the connector.

16. A part of a dance exercise pole as claimed in claim 15, arranged so the pole section may be selectively locked against rotation relative to the base.

17. A part of a dance exercise pole as claimed in claim 15, wherein an axle is supported on the base and the section journalled for rotation on the base is journalled for rotation on the axle and wherein the part is configured for selectively locking the section journalled for rotation on the base against rotation on the axle.

18. A part of a dance exercise pole as claimed in claim 15, wherein the connector comprises a first portion which is received in a bore formed in the section journalled for rotation on the base and a second portion which has external threading.

19. A part of a dance exercise pole according to claim 15, comprising a sleeve mounted to slide over the outside of the section journalled for rotation on the base and arranged to depend from the pole section.

20. A part of a dance exercise pole according to claim 19, wherein the sleeve is arranged to be detachably connected to the pole section.

21. A part of a dance exercise pole as claimed in claim 19, wherein the sleeve is formed at an end with an internal thread for engagement with an external thread formed on the first end of the pole section.

22. A part of a dance exercise pole as claimed in claim 19, wherein the sleeve has an outer diameter that is the same as an outer diameter of the pole section and wherein an internal diameter of the sleeve allows the sleeve to slide over the section journalled for rotation on the base.

23. A part of a dance exercise pole as claimed in claim 15, wherein the threaded portion of the connector is an externally threaded portion arranged for connection to the threaded portion of the pole section, the threaded portion of the pole section being an internally threaded portion.

24. A dance exercise pole kit comprising the part of the dance exercise pole as claimed in claim 15.

25. A dance exercise pole according to claim 1, wherein the pole section and the connector are arranged for selectively locking the pole section against relative rotation on the connector.

26. A dance exercise pole according to claim 1, wherein the connector comprises flats for engagement with grub screws associated with the pole section, for selectively locking the pole section against relative rotation on the connector.

27. A part of the dance exercise pole according to claim 15, wherein the connector is arranged for selectively locking the pole section against relative rotation on the connector.

28. A part of the dance exercise pole according to claim 15, wherein the connector comprises flats for engagement with grub screws associated with the pole section, for selectively locking the pole section against relative rotation on the connector.

* * * * *